US006840309B2

(12) United States Patent
Wilson et al.

(10) Patent No.: US 6,840,309 B2
(45) Date of Patent: Jan. 11, 2005

(54) HEAT EXCHANGER

(75) Inventors: Alexander Bruce Wilson, Barrhead (GB); Michael Willoughby Essex Coney, Swindon (GB); David John Gooch, Sutton (GB); Birendra Nath, London (GB); Andrew Powell, Bicester (GB)

(73) Assignee: Innogy Plc, Wiltshire (GB)

( * ) Notice: Subject to any disclaimer, the term of this patent is extended or adjusted under 35 U.S.C. 154(b) by 0 days.

(21) Appl. No.: 10/240,389

(22) PCT Filed: Mar. 30, 2001

(86) PCT No.: PCT/GB01/01455

§ 371 (c)(1),
(2), (4) Date: Apr. 1, 2003

(87) PCT Pub. No.: WO01/75383

PCT Pub. Date: Oct. 11, 2001

(65) Prior Publication Data

US 2003/0159815 A1 Aug. 28, 2003

(30) Foreign Application Priority Data

Mar. 31, 2000 (GB) ..... 0007925

(51) Int. Cl.[7] ..... F28F 7/00
(52) U.S. Cl. ..... 165/81; 165/162; 165/160
(58) Field of Search ..... 60/682, 657; 122/510, 122/4 D; 110/210, 212; 165/157, 81, 82, DIG. 917, DIG. 402, DIG. 417, 159–162

(56) References Cited

U.S. PATENT DOCUMENTS 2,202,494 A * 5/1940 Jacocks ..... 165/277
3,346,043 A 10/1967 Thurnauer
3,438,430 A * 4/1969 Kestemont ..... 165/277
3,880,232 A 4/1975 Parker
4,152,399 A * 5/1979 Germerdonk et al. ..... 423/210
4,584,969 A * 4/1986 Urbani ..... 122/136 R
4,690,206 A * 9/1987 Bein ..... 165/81
4,776,387 A * 10/1988 Newman ..... 165/76
4,858,681 A 8/1989 Sulzberger
4,904,455 A * 2/1990 Karafian et al. ..... 422/201
5,894,883 A * 4/1999 Gentry et al. ..... 165/81

FOREIGN PATENT DOCUMENTS

| | | |
|---|---|---|
| CH | 195 866 A | 5/1938 |
| DE | 24 58 140 A | 6/1976 |
| DE | 198 05 955 A | 3/1999 |
| FR | 2 495 755 A | 6/1982 |
| GB | 671375 | 6/1950 |
| GB | 2 150 276 A | 11/1984 |

* cited by examiner

*Primary Examiner*—Terrell McKinnon
(74) *Attorney, Agent, or Firm*—Birch, Stewart, Kolasch & Birch, LLP

(57) ABSTRACT

A heat exchanger comprising a pressure vessel (1). A plurality of serpentines (8) convey a fluid to be heated through the pressure vessel (1) in one direction. A duct (9) surrounding the serpentines (8) conveys a second fluid in the opposite direction to give up its heat to the first fluid. The duct (9) is spaced from the pressure vessel (1) and is surrounded with thermal insulation (23). An opening in the duct (9) equalizes the pressure between the inside and the outside of the duct (9) which is also supported against expansion caused by the pressure inside the duct (9) exceeding the pressure outside the duct (9).

21 Claims, 16 Drawing Sheets

5
1
19
4
22
9A
10
22
4A
14

HEAT EXCHANGER

This application is the national phase under 35 U.S.C. § 317 of PCT International Application No. PCT/GB01/01455 which has an International filing date of Mar. 30, 2001, which designated the United States of America.

BACKGROUND OF THE INVENTION (1) Field of the Invention

The present invention relates to a heat exchanger. The invention is applicable to any type of heat exchanger where heat from a first fluid stream is exchanged with heat from a second fluid stream.

(2) Description of Related Art

The invention has particular application to a recuperator which enables the hot gases leaving a high temperature source such as a furnace or gas turbine to heat the incoming air. Such a recuperator is used in the engine disclosed in FIG. 4 of WO 94/12785.

In this engine, a countercurrent recuperator is used to preheat cold isothermally compressed air for use in a combustion chamber using expanded exhaust gas from the combustion chamber. This engine can be made to work using a conventional recuperator from gas turbine technology (such as the Solar Mercury 50). However, the pressure and temperature of the exhaust gas of the engine of WO 94/12785 can be greater than in a gas turbine. For example, the exhaust gas pressure of the engine is $5\times10^5$ Pa (5 bar) as opposed to atmospheric for a gas turbine. The air entering the recuperator will, for example, be at $2\times10^6$ Pa (20 bar) for a gas turbine and $1\times10^7$ Pa (100 bar) or higher for the engine. The "hot" end of the recuperator (i.e. the end at which the hot exhaust gas enters and the heated air leaves) may be 750–800° C. for the engine as opposed to 500–600 ° C. for the gas turbine. The temperature difference between the "hot" and "cold" ends of the recuperator will also be greater for the engine with the cooled exhaust gas leaving the "cold" end at a temperature of typically 250–300 ° C.

Therefore, although a conventional recuperator is suitable for use with the engine, it is designed to operate with optimum efficiency at very high flow rates and relatively low pressure. The present invention aims to provide a heat exchanger which operates most efficiently at higher pressures and lower flow rates.

CH 195,866 discloses a heat exchanger having a duct inside a pressure vessel and a number of pipes passing through the duct. Small holes are provided in the wall of the duct in order to equalise the pressure across the duct. While this arrangement is effective to reduce or eliminate the stresses arising from a steady state, spatially uniform difference in the pressure across the duct walls, it does not address the effects of various other stresses acting on the duct. Firstly, there is a stress on the duct walls which arises from the steady pressure drop within the tube bundle and which causes a spatially non-uniform pressure difference across the duct walls. This could be overcome by arranging the small holes along the length of the duct to equalise the pressure differences at various locations along the duct. However, this leads to a flow along the space outside of the duct which will prevent this space from operating adequately as an insulator hence reducing the efficiency of the heat exchanger. A second source of additional stress arises from pressure pulsations which may be present as a result of flow transients, which may either be part of normal operation or may be the result of fault conditions. The heat exchanger of CH 195,866 is unable to accommodate these conditions and is therefore not suitable as a modern high pressure heat exchanger.

BRIEF SUMMARY OF THE INVENTION

According to the present invention a heat exchanger comprises a pressure vessel; a first passage provided within a plurality of tubes for a first stream in one direction through the pressure vessel; a second passage for a second stream in the opposite direction through the vessel, the second passage comprising a duct spaced from the pressure vessel and enclosing the tubes such that heat transfer occurs across the walls of the tubes; means to generally equalise the pressure between the inside of the duct and the space between the duct and the pressure vessel; thermal insulation between the duct and the inner surface of the pressure vessel; and a support to support the duct against expansion caused by the pressure inside the duct exceeding the pressure outside the duct.

Locally, the tubes form a cross-flow heat exchanger which gives a very good heat transfer. Globally, they form a counter-current heat exchanger which allows the minimum temperature difference between the two flows. However, the use of the tubes with a high temperature and high pressure exhaust gas requires a suitable pressure vessel which is also able to withstand the high temperatures. Materials, such as nickel alloys, which can fulfil both functions are prohibitively expensive.

For this reason, the present invention has the duct forming the second passage which is spaced from the pressure vessel and is also separated from the pressure vessel by thermal insulation. Thus, the pressure vessel is protected from the high exhaust gas temperatures.

Further, a number of measures are provides to reduce the stresses on the duct caused by the high pressure of the stream passing through the duct. In particular, the means to generally equalise the pressure between the inside and outside of the duct ensures that the duct does not have to cope with anything like the full pressure of the exhaust gas. Other stresses such as those caused by the pressure drop along the tubes and by pressure pulsations within the duct are accommodated by the support.

The pressure vessel can therefore be designed to cope with the full pressure of the exhaust gas at a relatively low temperature, while the duct must be able to withstand the maximum system temperature, but is not required to contain the full pressure of the exhaust gas and can therefore be made of thinner material. Therefore, the vessel requires far less of an expensive high temperature material than would be required in a vessel required to withstand the full system pressure and temperature.

The means to equalise the pressure between the inside of the duct and the space between the duct and the pressure vessel may, for example, be in the form of a supply of pressurised fluid connected to the space between the duct and the pressure vessel which is controlled in accordance with the pressure within the duct so as to equalise the pressures. However, preferably, the means to equalise the pressure is one or more through holes in the wall of the duct. These simply allow the fluid within the duct to bleed into the pressure vessel in which it is trapped in order to equalise the pressure.

If the or each through hole is provided at the cold end of the heat exchanger, this ensures that the gas bled into the pressure vessel is at its lowest possible temperature and hence will not damage the pressure vessel. Also, if the pressure vessel leaks, gas is drawn from the cold end of the duct thus limiting consequential damage. Further, to avoid any flow of gas along the space filled with insulation, the through holes are preferably all situated generally in a single plane perpendicular to the direction of flow of the streams through the vessel.

The purpose of the thermal insulation is to shield the inner wall of the pressure vessel from the high temperatures within the duct. Thus, the insulation may be provided to completely fill the space between the outer wall of the duct and the inside surface of the pressure vessel (provided that the insulation is completely gas permeable), may be provided on the inside surface of the pressure vessel, or may be provided by the wall of the duct itself. However, the current preference is for the thermal insulation to be provided against the outer wall of the duct.

Although the pressure is nominally equalised between the inside and the outside of the duct, it is possible that, in some applications, a non steady flow will result in pulses of increased or decreased pressure. If there is a pressure drop across the duct, this will also tend to stress the duct.

The support may be an internal support such as a plurality of tie rods. However, such a support has to be carefully configured to avoid interference with the tubes. The support is therefore preferably external to the duct, and preferably substantially surrounds the duct.

The external support may, for example, be provided by external reinforcing ribs. However, the presently preferred way of supporting the duct is to surround the duct with insulation held against the wall of the duct using the support. The support is preferably provided by one or more cables which surround a substantial portion of the duct. The cables may be anchored to the inner wall of the pressure vessel or may pass all the way around the duct in a complete circle. The or each cable is preferably spring loaded so as to allow the duct to expand and force the insulation outwardly, and to push the insulation back against the walls of the ducts upon thermal contraction of the duct. This allows the supporting of the duct to be provided by the insulation, so that the duct can be made thin-walled. It also ensures that the insulation is maintained in close proximity with the duct thereby maintaining adequate support at all times.

Preferably, the or each cable is supported on a spine or a series of upstands projecting outwardly from a plate which extends across the outer face of the insulation. In this way, the support provided by the cable is applied across the outer face of each block, rather than simply at its corners.

The duct preferably rests on a base within the pressure vessel. Insulation is preferably provided between the base and the duct. The base is preferably detachable from the pressure vessel in order to simplify construction, assembly and maintenance of the vessel internals. In order to allow for horizontal thermal expansion of the duct within the pressure vessel, it is preferably supported such that it is free to expand horizontally. It is preferable for the duct to be fixed to the base only at the hot end to allow for such expansion.

The tubes are also susceptible to thermal expansion. This thermal expansion can be accommodated, for example, by flexing of bends provided in the tube. This is acceptable under certain thermal loads. However, as the thermal loads are increased, the stress on the tubes, which are already under stress caused by the high internal pressure, may be raised to an unacceptably high level. Any additional thermally induced stresses will therefore reduce the creep life of the tubes. Therefore, in order to reduce the stresses and prolong the life of the tubes, the tubes are preferably prestressed in their cold condition. Thus, when the tubes are heated in use the thermal expansion only results in the prestress relaxing out.

Preferably the tubes are tensioned by tie rods which pass through the wall of the pressure vessel.

The tubes and the duct may be made of a single material which is capable of withstanding the maximum temperature and pressure to which they will be exposed. However, given the considerable variation of temperature and pressure across the heat exchanger, the duct and/or the tubes are preferably made of a number of different parts each of a different material connected in series. In this way, the use of an expensive material capable of withstanding the full system temperature or pressure can be reduced in favour of less expensive materials.

Preferably, a header assembly comprising a number of headers is provided within each end of the pressure vessel in order to convey fluid to and from the tubes. Preferably, a plurality of passages are provided to convey the heated fluid from the tubes and out of the pressure vessel. Using more than one pipe allows thinner walled pipes to be used which are less susceptible to thermal shock during start up and shut down. This allows the heat exchanger to be brought up to its operating temperature much faster than would otherwise be the case. Also, the pipes with thinner walls and smaller diameters have sufficient flexibility to take up their own thermal expansion and thus do not require the use of bellows or other means to compensate for the thermal expansion. If the heated air from the recuperator is split and fed to a number of combustor cylinders of the reciprocating engine, the number of pipes leading from the header is preferably a multiple of the number of cylinders in the combustor allowing the hot air to be fed to each cylinder individually, which is far easier than attempting to split a single flow between the various cylinders.

The header assembly at at least one end is preferably configured such that each complete tube can pass by or through the header assembly. This allows for easy maintenance of the heat exchanger in which an individual tube can be removed from the heat exchanger by detaching it from the header assemblies at either end and withdrawing it through one of the header assemblies.

Each of the tubes may simply be a straight tube. However, in order to allow for a sufficient length of tube to cause the desired heat transfer without having an unduly long pressure vessel, the tubes are preferably tortuous. The current preference is for sinuously wound tubes. These consist of a number of straight tube sections connected by 180 degree bends. The external gas flows over the straight tube sections in a crossflow configuration, but the succession of 180° beds provides an overall counter-current flow path of the internal air with respect to the external gas. A further advantage of this arrangement is that it can accommodate a substantial tube length in a compact way and in a manner which provides for thermal expansion by flexing of the tube at the bends.

Each sinuously wound tube is preferably wound in a single plane, so as to produce a flat structure. The tubes are then preferably arranged one on top of another.

In order to improve external heat transfer with the gas flowing over the tubes, a series of fins or turbulence enhancers may be provided on the outside of the tubes. The fins may be in contact with the tube surface in order to conduct additional heat into the tube or they may be detached, in which case they would act only as turbulence enhancers. Alternatively, internal fins or turbulence enhancers can be provided to improve the heat transfer with air flowing inside the tubes. Since the overall heat transfer performance is generally limited by the external heat transfer, the greatest benefit is obtained by some form of external finning and/or turbulence enhancement. In particular the fins may project radially outwardly in a plane perpendicular to the local longitudinal axis of the tube and may project uniformly around the entire circumference of the tube or the fins may be shaped or cropped in order to allow close packing of neighbouring tubes.

A simpler alternative, which could be provided more cheaply in the case of a sinuously wound tube would be to weld on fins, which would run longitudinally along rather than around straight sections of the tube.

These fins could be placed only at positions, which do not obstruct neighbouring tubes. This option would not add as much surface area as the option of circumferential fins, but it could improve the heat transfer by increasing turbulence and directing the flow more effectively onto adjacent tubes. Naturally, it would be important to obtain a satisfactory balance between increased pressure loss and improved heat transfer.

Additional enhancement of heat transfer may be achieved by the use of internally ribbed tubing or turbulence promoters inside the tubes. For example, a turbulence promoter in the form of a spiral may be inserted into each straight length of tubing prior to bending.

Each winding of the sinuously wound tube preferably extends across the full width of the duct and rests on a tube support at each side of the duct with a clearance between the winding and the wall of the duct. This is particularly advantageous since it allows the individual bends to move relative to each other to accommodate differential thermal expansion. The tube support also facilitates the assembly the tubes and permits removal (if necessary) of individual tubes for repair or maintenance.

When a single duct is used, the tubes must extend across the full width of the duct to be supported at opposing sides of the duct. Since the ratio of the air mass flow to the gas mass flow is fixed, it is important that the available flow area available to the gas, which must flow through the gaps between adjacent tubes, is considered in relation to the flow area available to the air inside the tubes. If this is not done, there may be excessive velocities in one fluid leading to high pressure losses in that fluid combined with low flow velocities in the other fluid leading to poor heat transfer. If the internal and external diameters of the tubes and the gap between adjacent tubes are already decided by other factors, then it is important that the length of the straight, crossflow section of the tubes (normally equal to the width of the duct) is chosen in such a way that a suitable balance of the two flow areas is achieved. This may cause a problem if the total number of tubes leads to a rectangular duct cross-section, which is either much taller or much shorter in relation to its width. In either case, it makes the cylindrical pressure vessel much larger than it should be in relation to the number of tubes, which it contains.

If the required number of tubes is too many to be accommodated in a duct of approximately square cross-section, and other constraints do not allow sufficient adjustment of other parameters, then one option is to provide one or more tube supports spaced from the sides of the duct and extending along the duct in the direction in which the streams pass through the vessel. This allows two or more tubes to be supported side by side within the duct. The or each tube support would run the whole length of the duct and extend over the full height of the duct. An arrangement with one tube support would, for example, provide a duct of about twice the width and half the height, without upsetting the necessary balance of flow areas. This is because there is now an air flow cross-section of two tubes within the width of the duct, as opposed to only one in the previous arrangement.

Instead of providing one or more tube supports down the centre of the duct, the same result can be achieve by providing two or more duct sections each extending in parallel in the direction in which the streams pass through the pressure vessel. The current preference is for two ducts arranged side by side, thus halving the length of each sinuously wound tube. The duct sections are more easily removed from the pressure vessel through a header assembly than a single duct.

Preferably the tubes rest on ledges fixed to the walls of the duct such that the tubes are free to slide on the ledges. This allows for local thermal expansion of the tubes, and helps facilitate their removal from the duct An example of a heat exchanger constructed in accordance with the present invention will now be described with reference to the accompanying drawings, in which:

DETAILED DESCRIPTION OF THE INVENTION

Figure 4:
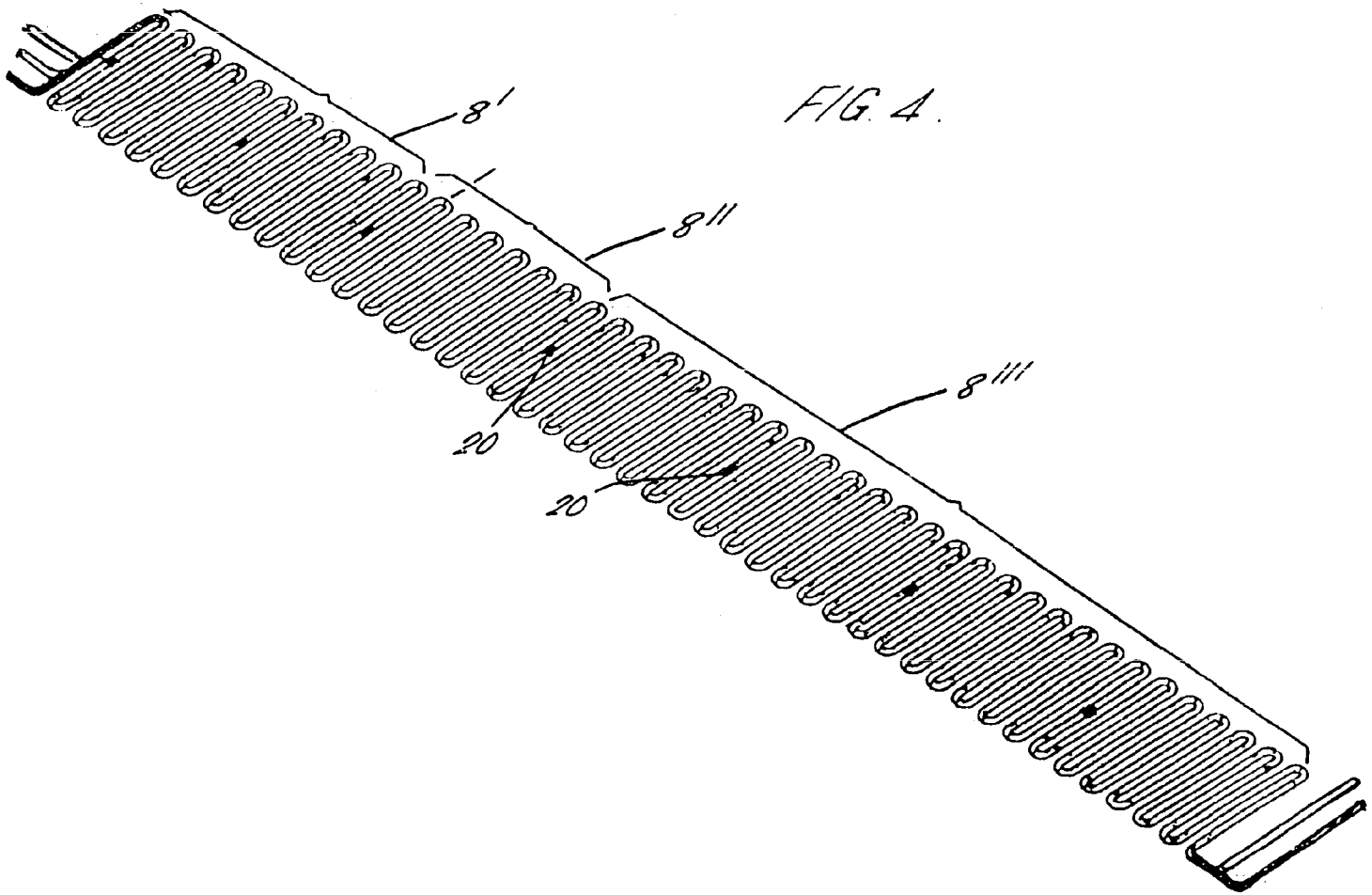
FIG. 4 is a perspective view showing a single serpentine.

The heat exchanger described is a recuperator which is designed for use with an engine as disclosed in. FIG. 4 of WO 94/12785. The recuperator is designed to exchange heat between a cold flow of isothermally compressed air and a hot stream of expanded exhaust gas from a combustor. The heated compressed air leaving the recuperator is then fed to the combustor.

Figure 1:
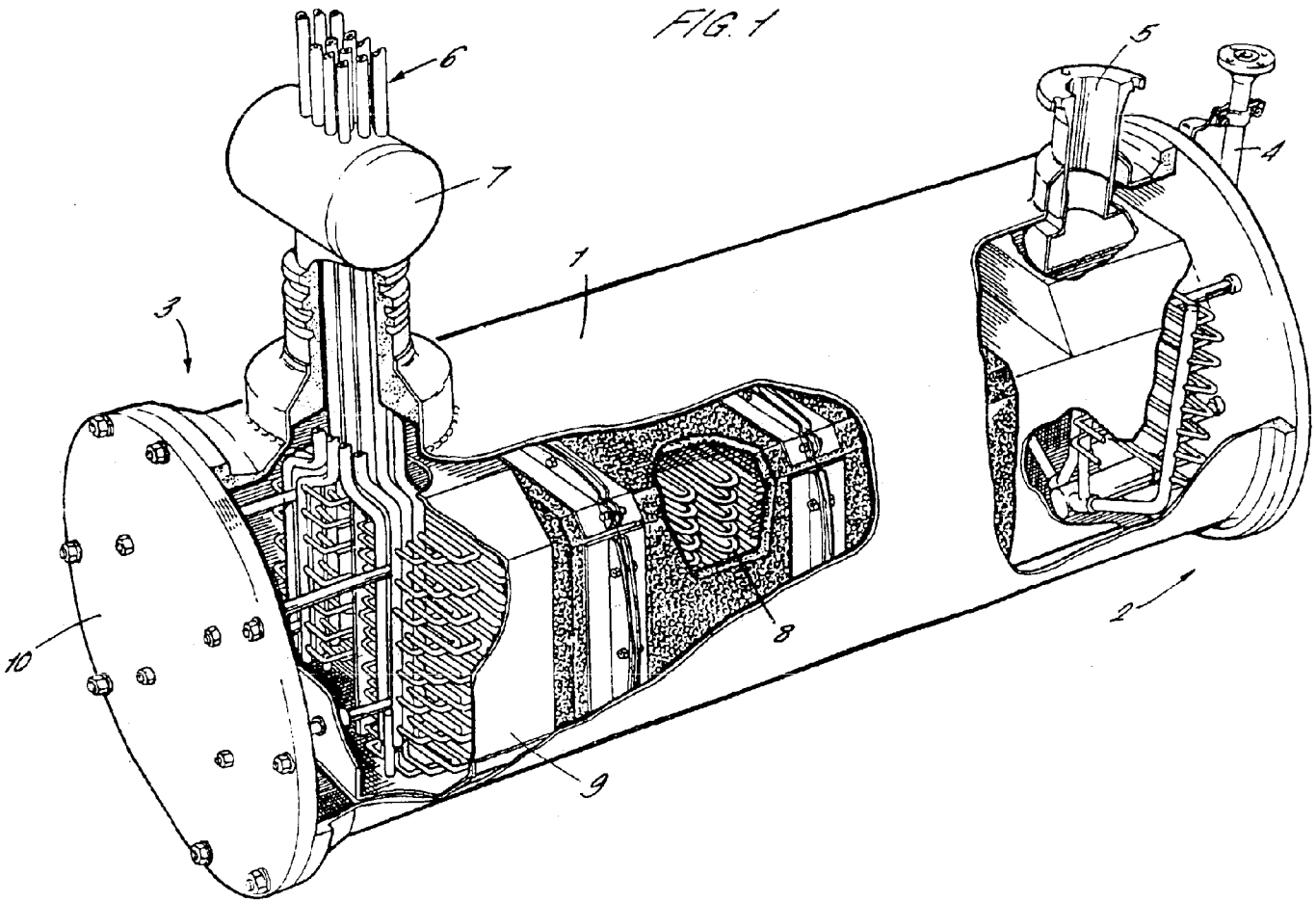
FIG. 1 is a perspective view of the heat exchanger with parts of the pressure vessel and duct broken away to show the internal detail.

As shown, for example in FIG. 1, the recuperator comprises a pressure vessel 1 (e.g. of mild steel) inside which all other elements are housed. The recuperator has a cold end 2 and a hot end 3. A cold compressed air inlet 4 and a cold exhaust outlet 5 are provided at the cold end, while a hot compressed air outlet 6 and a hot exhaust inlet 7 are provided at the hot end. A plurality of serpentines 8 as described in detail below convey the compressed air from the cold end 2 to the hot end 3. A duct 9 having a substantially rectangular cross-section surrounds the serpentines 8 and conveys the exhaust gas from the hot end 3 to the cold end 2. The recuperator therefore acts as a counter current heat exchanger with heat being transferred across the walls of the serpentines from the exhaust gas to the compressed air.

The pressure vessel 1 is essentially cylindrical and has two circular end plates 10 bolted on at either end.

Figure 2A:
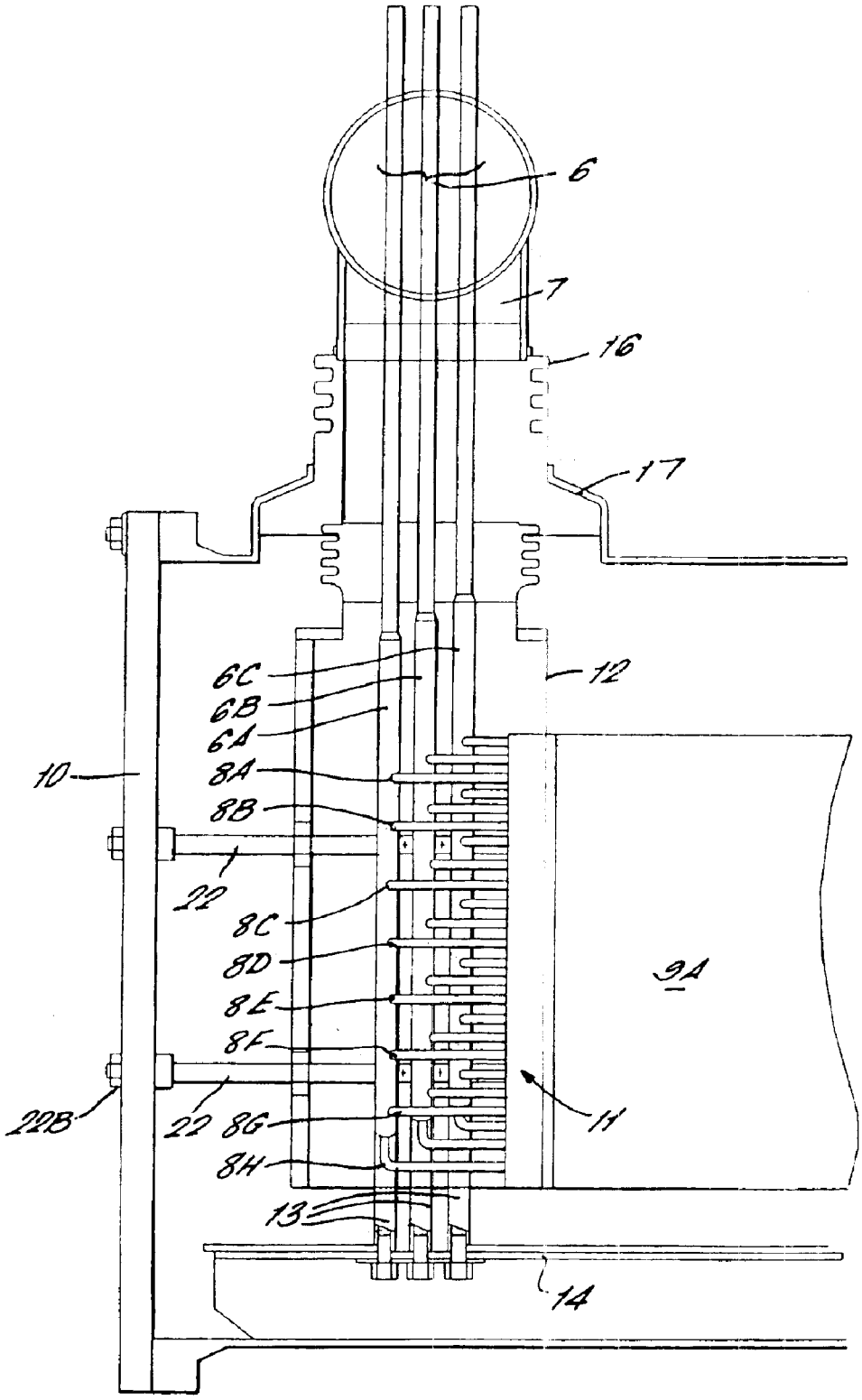
FIG. 2A is a side elevation of the hot end with the side wall of the pressure vessel removed, and some parts shown in section.
Figure 2B:
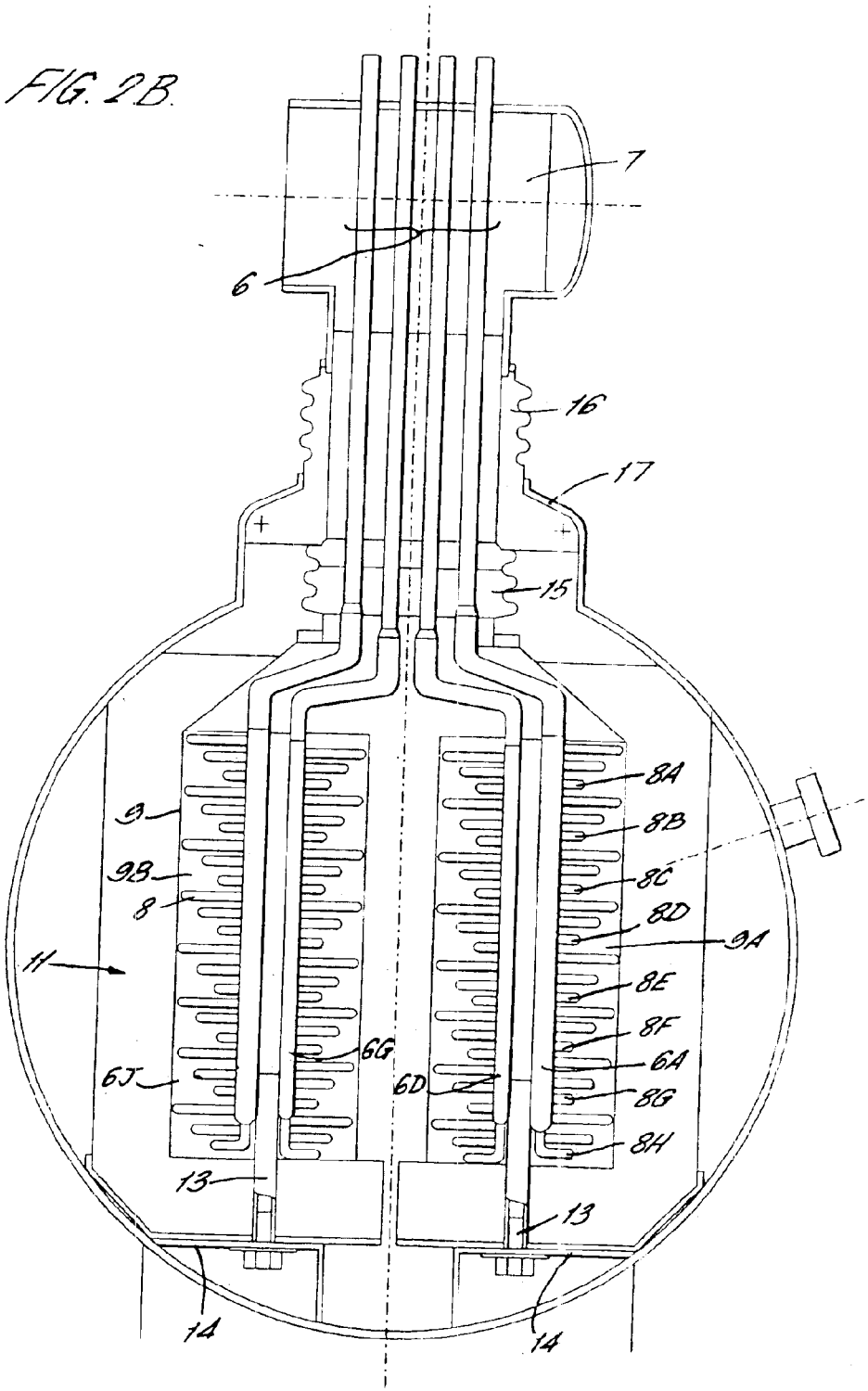
FIG. 2B is an end elevation of the hot end with the side wall of the pressure vessel removed, and some parts shown in section.

A hot header assembly 11, as shown in FIGS. 2A–2D, is provided within the duct 9 and serves to connect the plurality of serpentines 8 with the outlet 6. In fact, the outlet 6 comprises twelve separate pipes 6A–6L extending vertically downwardly into the duct 9. As is apparent from FIGS. 2A and 2B, the hot exhaust inlet 7 leads to a duct manifold 12 which then splits the exhaust flow between two longitudinally extending duct sections 9A, 9B. Six of the hot compressed air outlet pipes 6A–6L lead from each duct section 9A, 9B. The structure of each duct section is identical and only the structure of one of these will be described below. Each pipe 6A–6L is connected to several of the serpentines 8. For example, as shown in FIGS. 2A and 2B the pipe 6A is connected to eight serpentines 8A–8H. Similar connections are provided to all of the remaining pipes 6D–6L.

The header assembly 11 is held in place by six bolts 13 which pass through the base of the duct 9 and are anchored to duct base plate 14 on which the duct rests. The hot exhaust gas inlet 7 is provided with a bellows section 15 to accommodate vertical thermal expansion. A similar bellows section 16 is provided on a port 17 in the pressure vessel through which the hot compressed air outlet and hot exhaust inlet pass from and to the pressure vessel respectively.

Figure 3A:
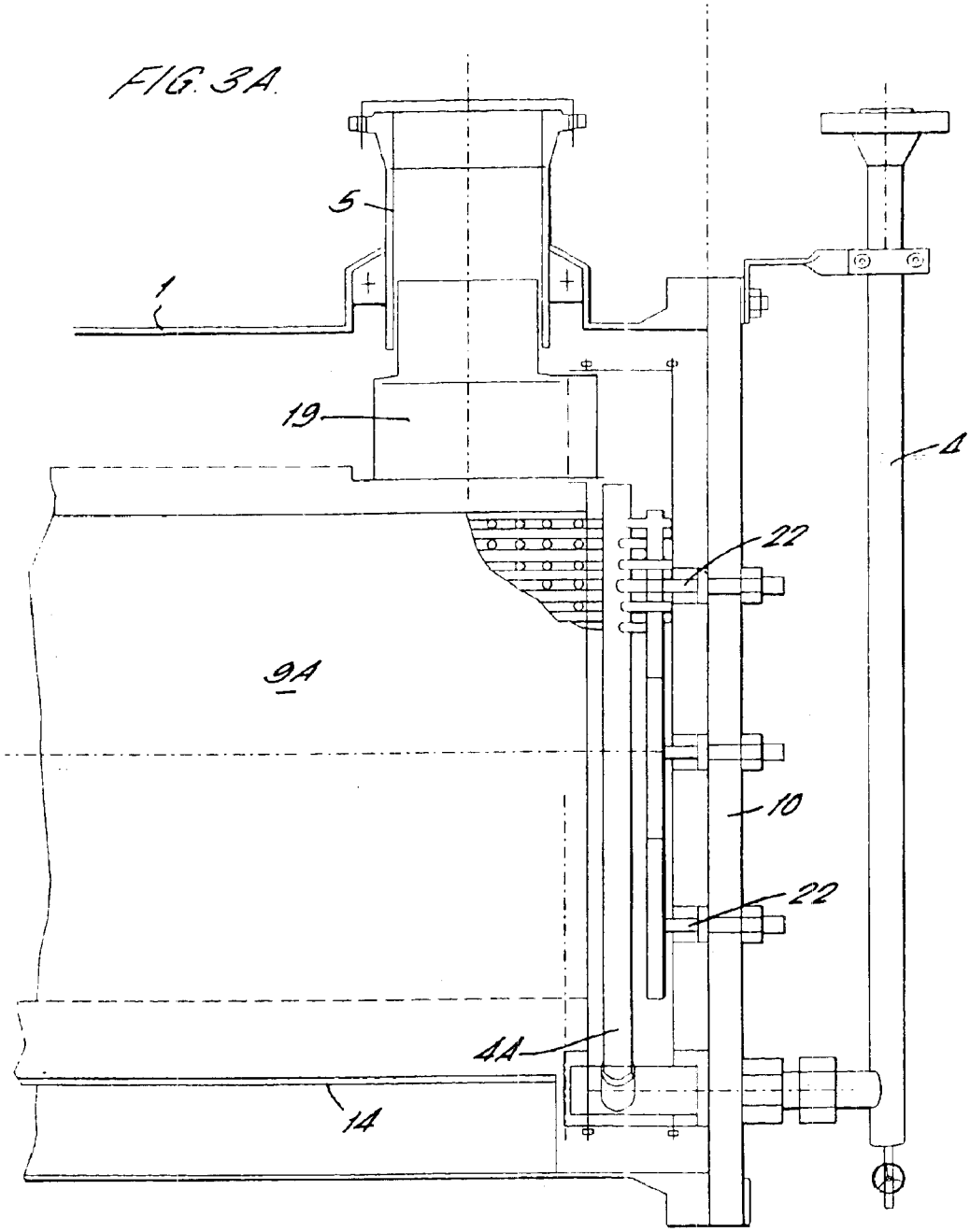
FIG. 3A is a view similar to FIG. 2A but of the cold end.
Figure 3B:
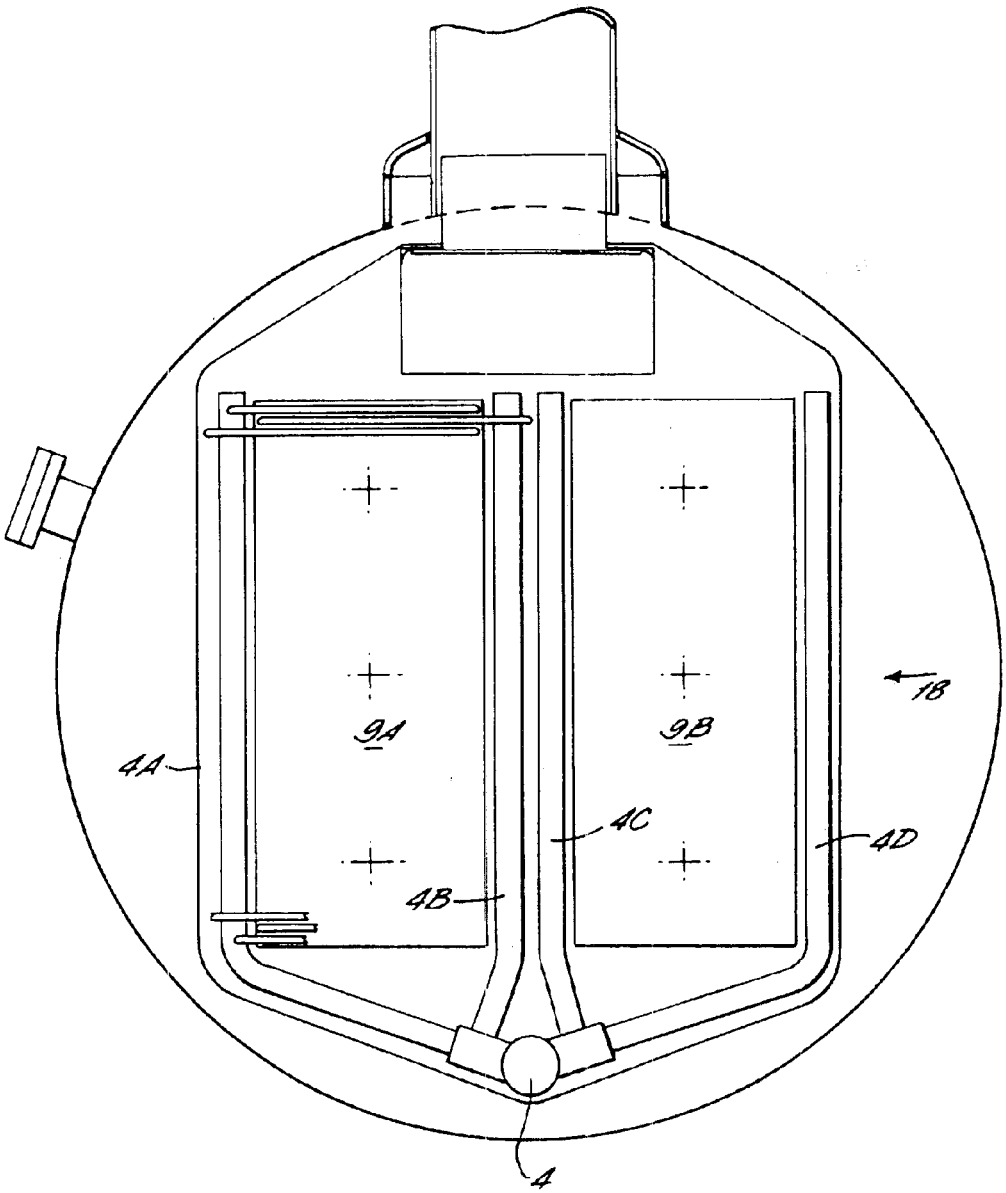
FIG. 3B is a view similar to FIG. 2B but of the cold end.
Figure 3C:
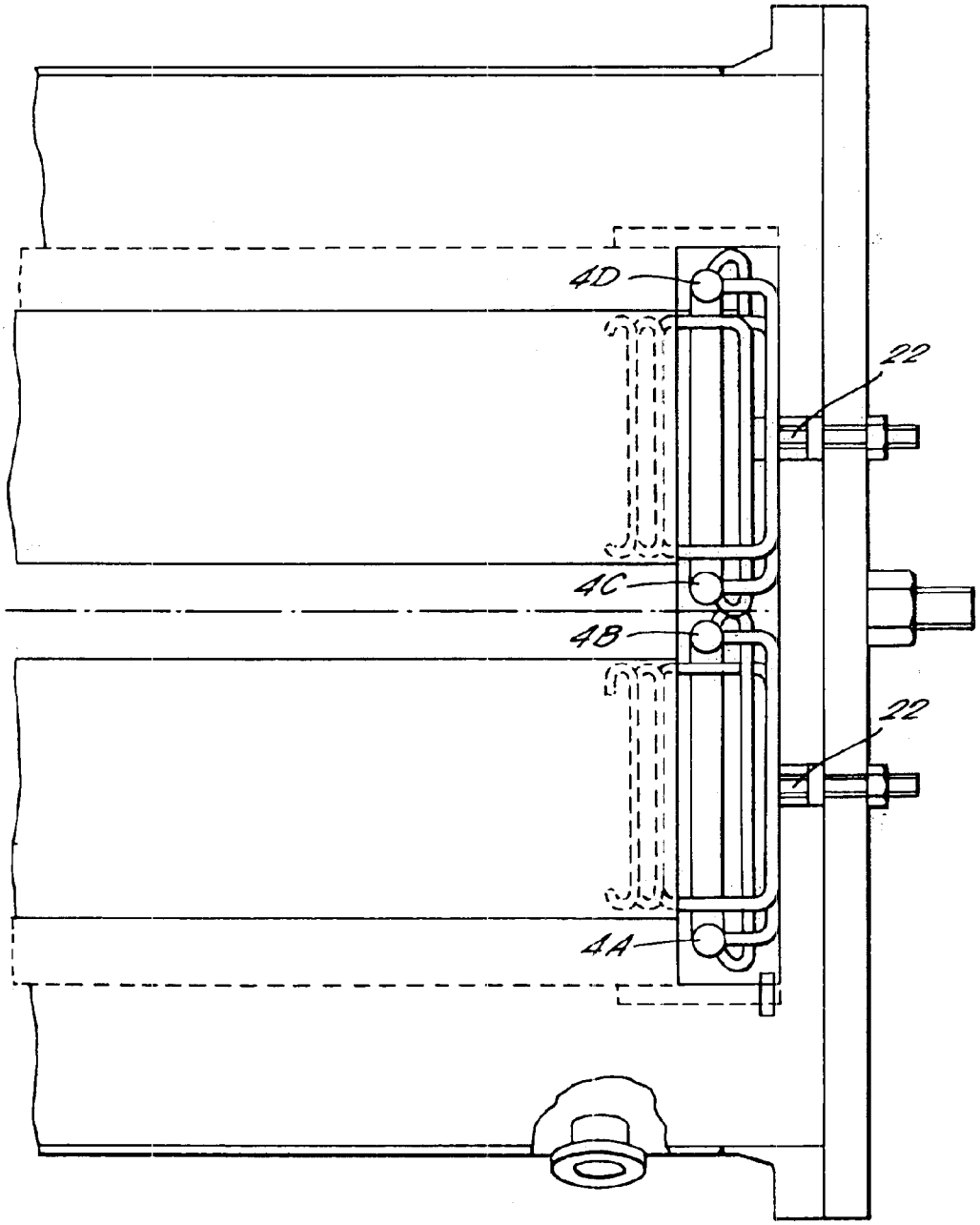
FIG. 3C is a view similar to FIG. 2C but of the cold end.
Figure 3D:
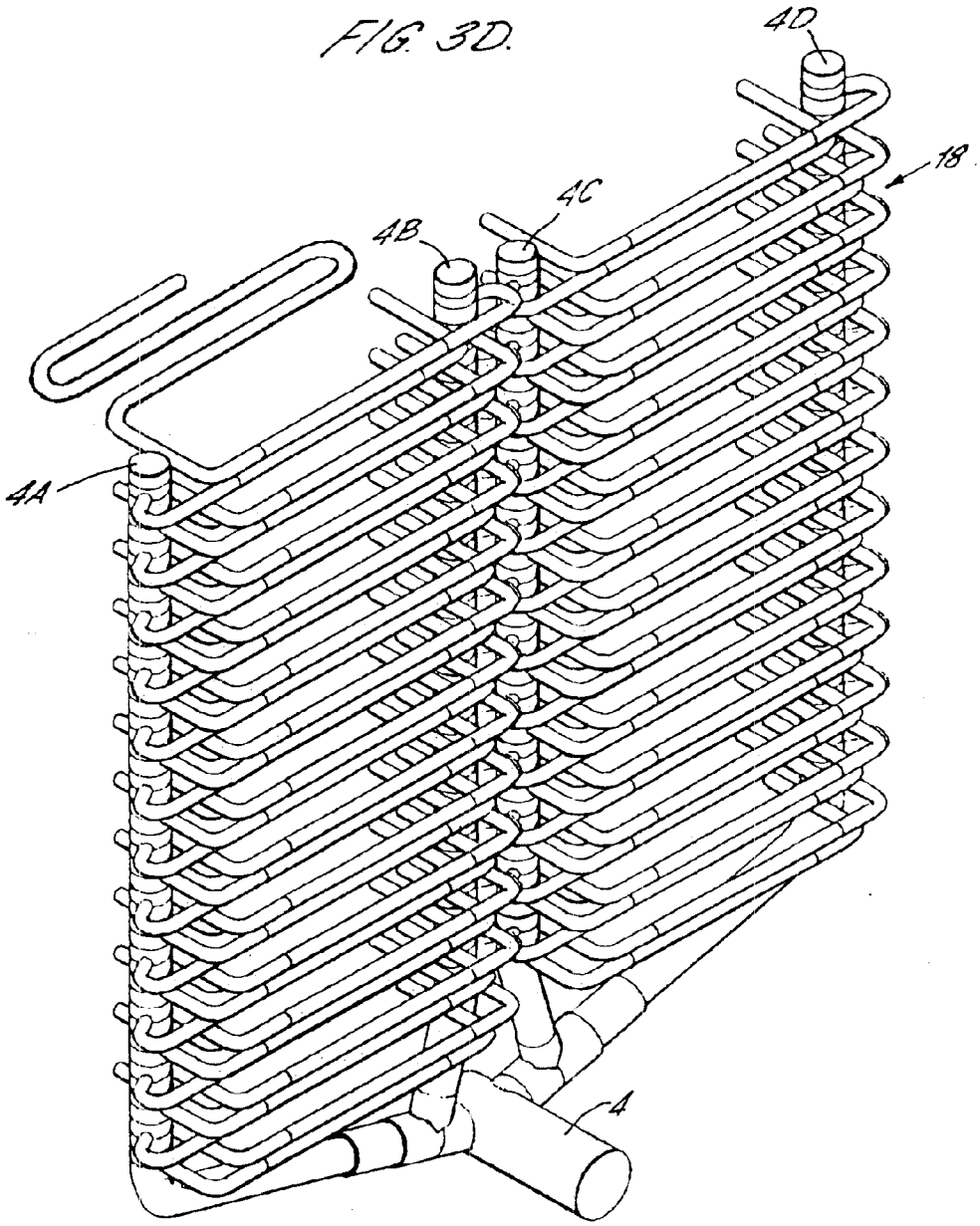
FIG. 3D is a perspective view showing the cold end header assembly only.

The cold end of the vessel will now be described with reference to FIGS. 3A–3D. At the cold end 2 a cold header assembly 18 is provided to transfer the cold air from the cold compressed air inlet 4 to the serpentines 8. Cold compressed inlet 4 branches into four pipes 4A–4D which are arranged just beyond the vertical edges of the two duct sections 9A–9B as best shown in FIG. 3B. The spacing of the pipes 4A–4D is so as to allow individual serpentines 8 to be withdrawn from the pressure vessel by removing the end plate 10 at the cold end 2, detaching the serpentine from the pipes 4A–4D, 6A–6L to which it is fixed, and removing it axially from the pressure vessel 1 via the cold end. Each of the cold compressed air inlet pipes 4A–4D is connected to a larger number of serpentines 8 than are connected to each of the hot compressed air outlet pipes 6A–6L. The number of pipes shown connected in FIG. 3D has been reduced in order to clarify the drawing. However, in practice, there will, of course, be the same number of connections between the serpentines 8 and the hot header 11, and the serpentines and the cold header assembly 18.

The ducts 9A, 9B lead via a duct manifold 19 to cold exhaust outlet 5. The cold header assembly 18 is not fixed to the base plate 14 so as to allow for thermal expansion of the duct 9 on the base plate 14.

A single serpentine will now be described with reference to FIG. 4. The serpentine is a small diameter tube which is coiled into a large number of sinuously wound turns by alternately bending the pipe in opposite directions. This is preferably done by cold bending the pipe in an automatic bender to a very tight radius with all bends being formed in a common plane. Each serpentine is made up of a number of sections 8', 8", 8'" of different materials. The first section 81 is designed for the hottest part of the recuperator to withstand temperatures of up to 770° C. The second section 8" is designed for an intermediate part of the heat exchanger and can withstand temperatures of up to 650° C., and the third section 8'" is for the colder part of the heat exchanger and can withstand temperatures of up to 561° C. For example, NF709 (high temperature, exotic stainless steel) can be used at the hot end, 321 stainless steel at the mid section, and 2¼Cr low alloy steel at the cold end. Each of the sections are welded together by welds 20. In fact, each section of a different material may in itself be made up of several sections also welded together by welds 20.

Figure 5:
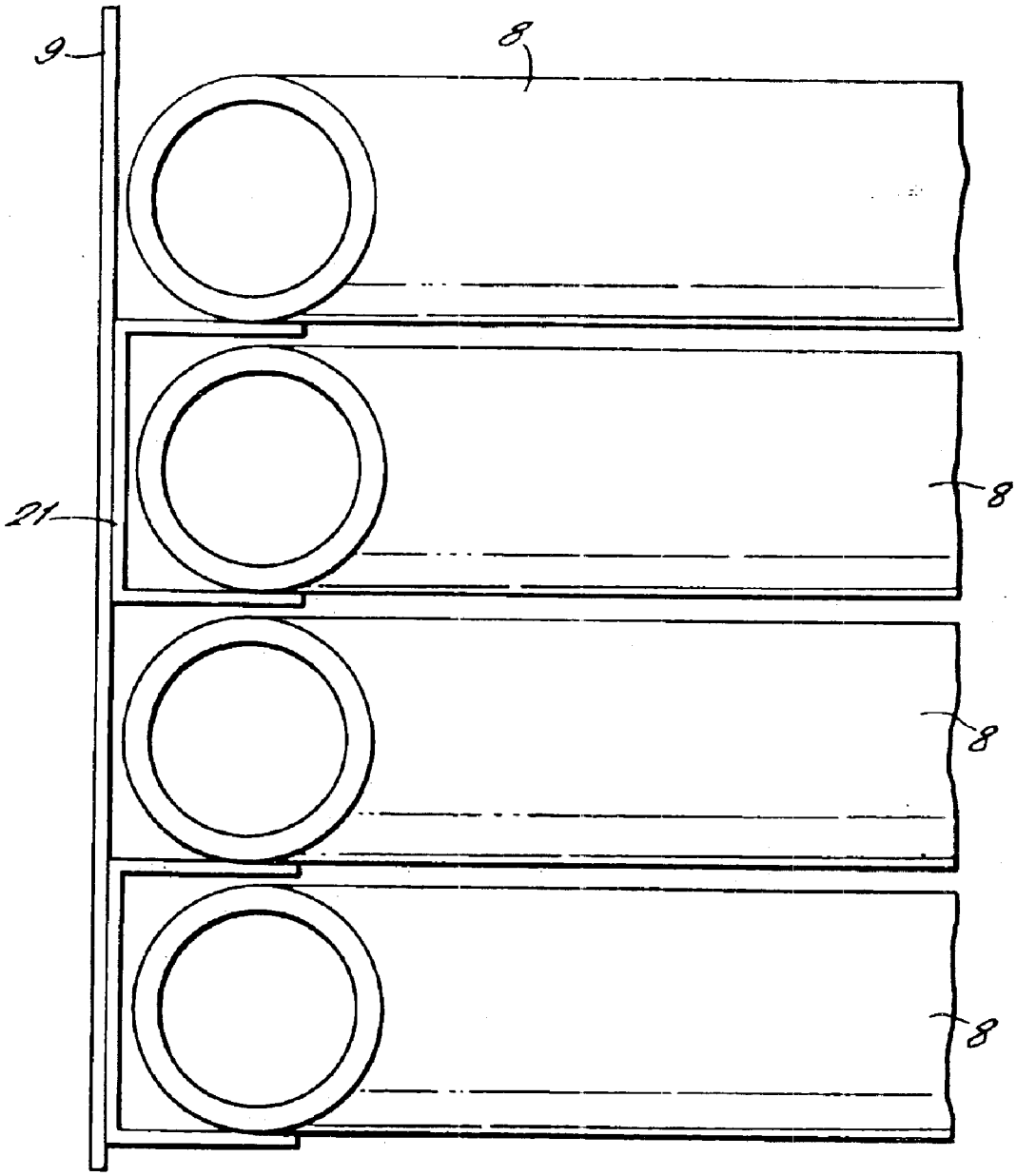
FIG. 5 is a schematic cross-section through a portion of a duct and parts of four serpentines showing the mounting of the serpentines within the duct.

As shown in FIG. 5, each of the serpentines are supported along either side by duct wall 9. The duct itself may be made up of different materials, for example, Haynes 230 (expensive nickel alloy) at the hot end and 321 stainless steel at the cold end. Each duct wall is provided with a plurality of longitudinally extending channel shaped brackets 21 extending between the hot 2 and cold 3 ends. A suitable clearance is provided between each serpentine 8 and bracket 21, and the serpentines are not fixed to the bracket so as to allow for thermal expansion of the serpentines. This also provides for simple withdrawal of an individual serpentine 8 described above. As an alternative to the bracket 21 angle sections could be used.

Figure 7A:
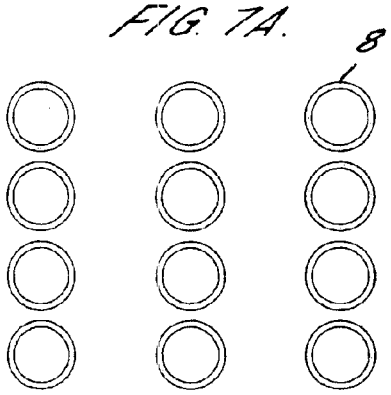
FIGS. 7A–7H are cross-sections in a vertical plane parallel to the main axis of the pressure vessel showing three turns of a number of serpentines having various configurations.

The serpentines 8 may be stacked in an in-line configuration (as shown in FIG. 7A), i.e. with the turns of one serpentine directly above those of the one below. Alternatively, the serpentines 8 may be staggered (as shown in FIG. 7B) with the turns of one serpentine being offset by half of the pitch of adjacent turns with respect to those of the one below.

Figure 7B:
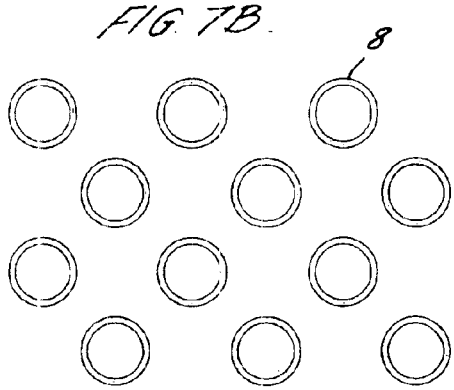

Staggered tube arrangements such as shown in FIG. 7B increase the minimum gap between the tubes and hence reduce the gas maximum velocity, which is an important parameter determining both heat transfer and pressure loss. It is not easy to move the tubes closer together to compensate for the increased gap because the bends and the tube supports interfere with each other. Thus in this situation, contrary to conventional experience, a change to staggered tubing reduces the heat transfer performance. Depending on the overall design, the reduction in pressure loss of a simple staggered tube arrangement such as that in FIG. 7B would probably not be sufficient compensation for the degradation of heat transfer relative to that of an in-line array as in FIG. 7A.

Figure 7C:
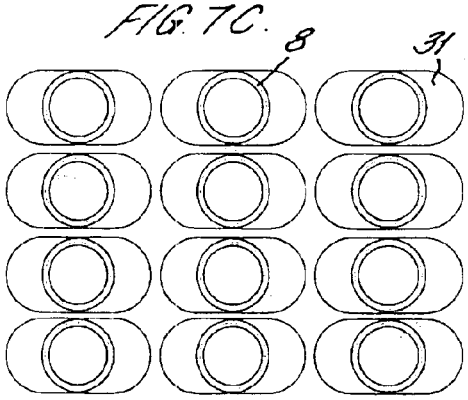
Figure 7D:
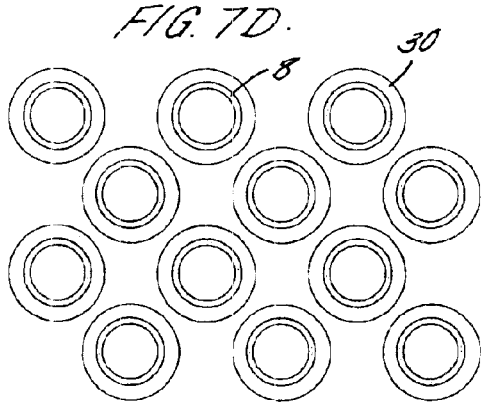

Conventional circular fins 30 may project from the serpentines to improve heat transfer (as shown in FIG. 7D). Alternatively, the fins 31 may have a non-circular shape as shown in FIG. 7C so as not to interfere with the adjacent serpentines. This is particularly applicable to serpentines arranged in an in-line configuration where turns of adjacent serpentines will be close together.

Figure 7E:
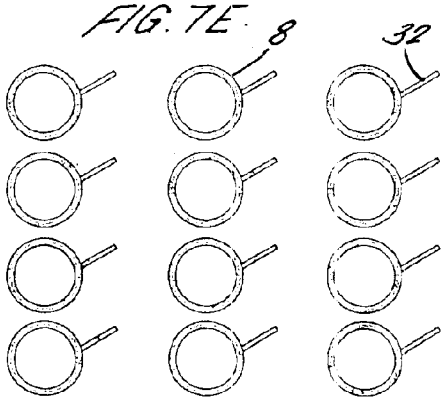

A further alternative is to provide a single deflector 32 on each straight section of tubing which projects outwardly and extends axially along the straight section, i.e. out of the plane of the paper as shown in FIG. 7E. These deflectors 32 can be positioned to deflect exhaust gas so that it impinges on a downstream tube. If the deflectors 32 are fastened to the tubes in such a way that there is good thermal contact, they will bring the further benefit of additional surface area and a path for heat to flow from the deflector to the tube. Alternatively, such deflectors could be provided as separate elements not attached to the serpentines. In this case, it is envisaged that a number of vertically aligned deflectors will be joined together on a louvre like structure.

Figure 7F:
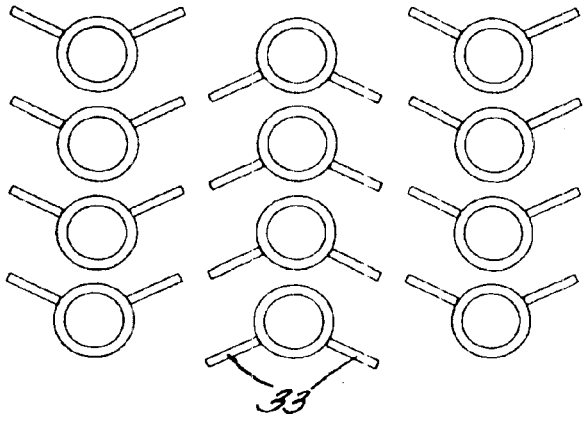
Figure 7G:
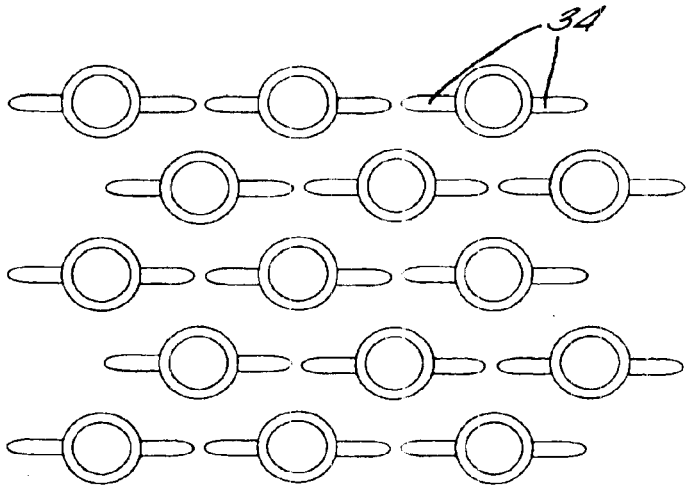
Figure 7H:
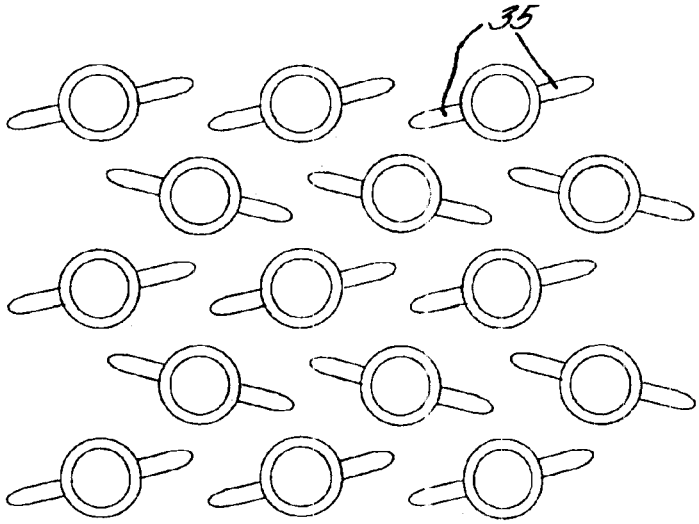

FIG. 7F shows a variation involving fins 33 on both sides of tubes mounted in an in-line configuration. This provides more surface area than FIG. 7E. FIG. 7G shows a staggered tube arrangement with fins 34, which are not angled to the flow, on both sides of tubes. This gives low pressure losses and the additional surface area would help to improve the heat transfer of the basic staggered arrangement. FIG. 7H shows an improvement in which angled fins 35 are placed on both sides of staggered tubing in such a way as to increase surface area, reduce the minimum gap and provide deflection of the flow onto adjacent heat transfer surfaces. Sufficient spacing to avoid interference between adjacent bends and tube supports is still maintained and it is still possible to withdraw individual tubes for maintenance if required.

Figure 2C:
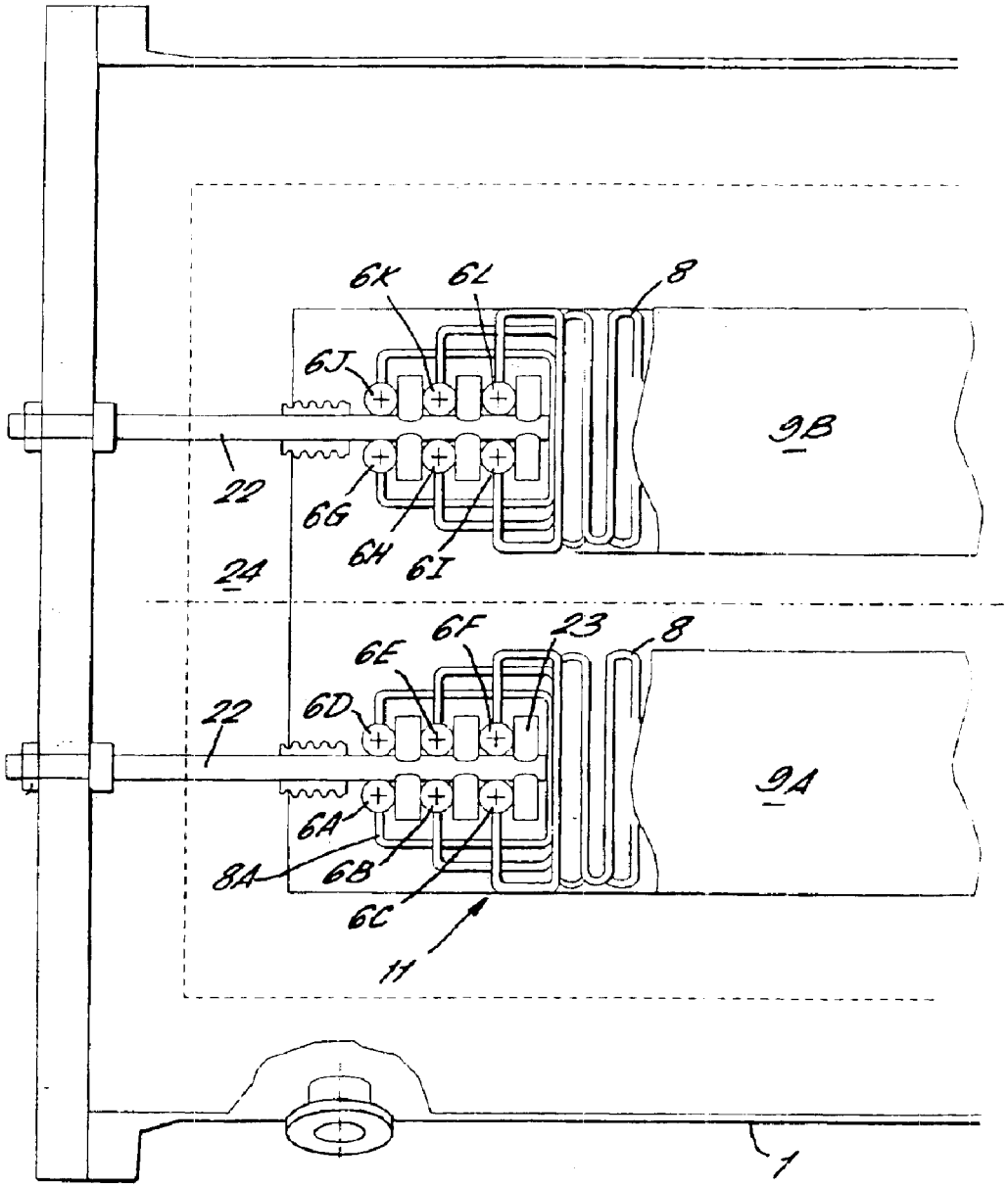
FIG. 2C is a plan view of the hot end with the end wall of the pressure vessel removed.
Figure 2D:
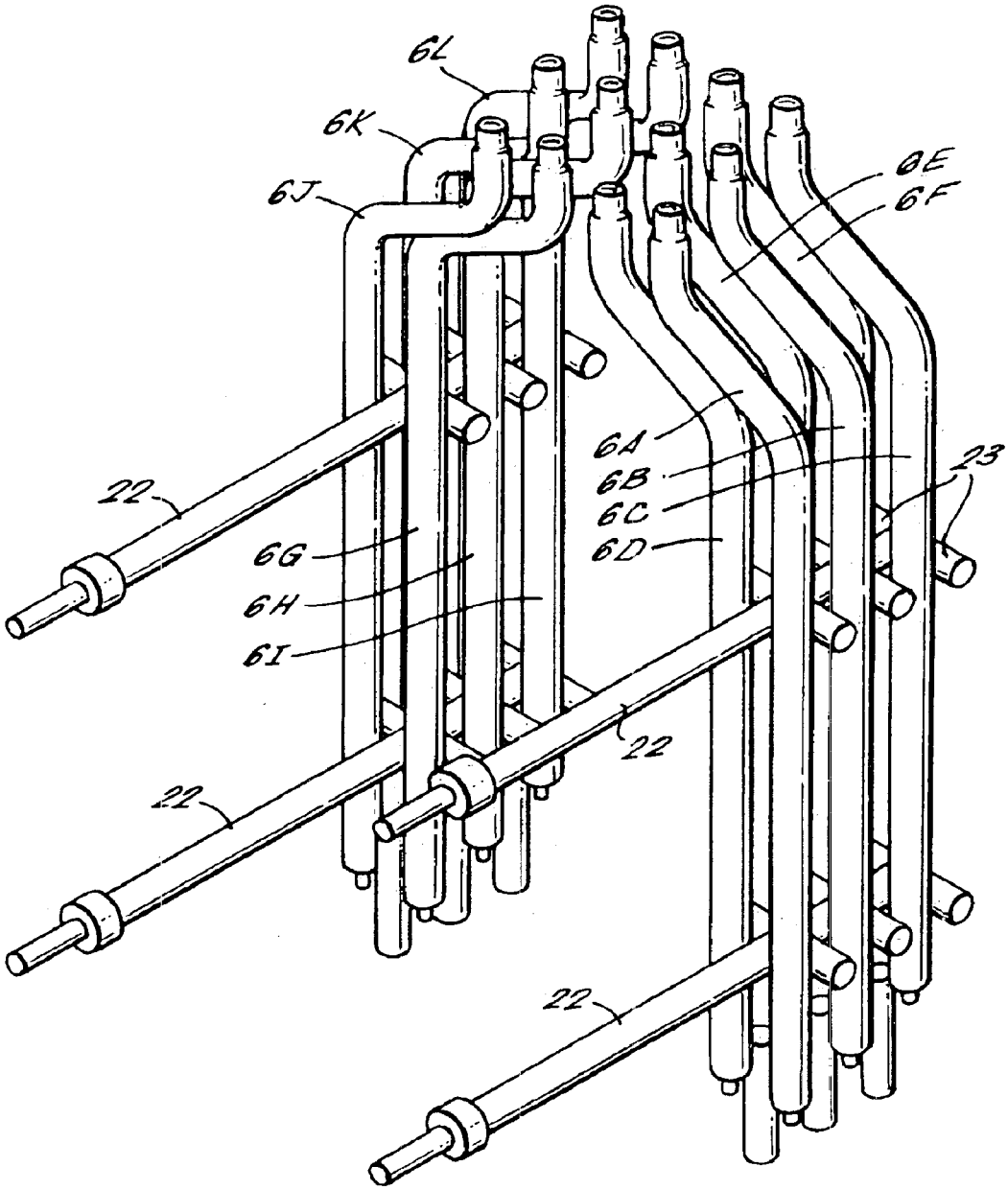
FIG. 2D is a perspective view showing the header and the tie bars only at the hot end.

The serpentines are supported in a prestressed condition. This is done with a system of tie rods 22. Four such tie rods 22 are provided at the hot end as shown in FIGS. 2A, 2C and best shown in FIG. 2D. The tie rods have a number of outwardly extending flanges 22A at one end which engage with the hot compressed air outlet pipes 6A–6L. The opposite ends of the tie rods extend through end plate 10 where they are fastened by nuts 22B. Tensioning of the serpentines 6 is achieved by tightening the nuts 22B such that the tension is transmitted to the serpentines by engagement of the flanges 22A of the tie rods 22 with the hot compressed air outlet pipes 6A–6L. A similar arrangement, this time with six tie rods 22 is used at the cold end 2.

Figure 6A:
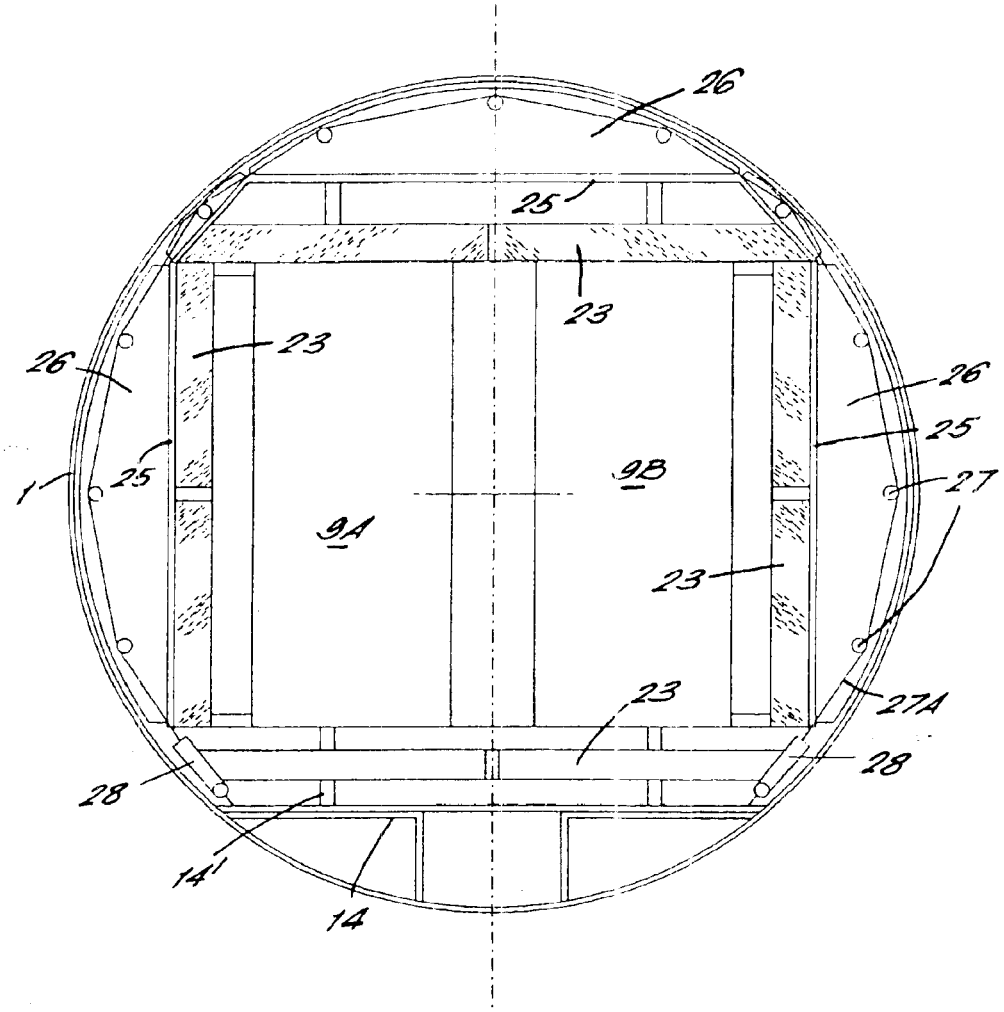
FIG. 6A is a transverse section in a vertical plane through a central portion of the heat exchanger.

The way in which the duct 9 is supported and insulated will now be described with reference to FIGS. 6A, 6B. The duct 9 is surrounded on all sides by blocks of insulation 23 (typically calcium silicate blocks). Additional blocks of insulation 24 are provided to cover the hot end of the duct 9 as shown in FIGS. 2A and 2C. The blocks are arranged like bricks around the duct. Two layer of blocks are used so that the joins between blocks may be staggered. This ensures that there is not a direct heat path through the insulation. Where blocks may pull apart from each other a packing piece of flexible ceramic wool insulation, such as Kaowool or rockwool, may be used which will expand to fill the gap.

Other than the bottom blocks on which the duct 9 rests, the blocks of insulation 23 are each provided with a plate 25 from which a spine 26 extends across the full width of each block. The plates 25 are held against, but not fixed to the blocks 23. At the bottom of each side plate 25, a number of tags 25' project towards the wall of the pressure vessel. These tags rest on a lip 14' extending upwardly from the base plate 14 as shown in FIG. 6B. The effect of this is that the centre of gravity of each side plate 25 is positioned radially inwardly of the point of support, such that even if the cable supporting the plate fails, it will still tend to be urged towards the insulation block 23 by gravitational forces. As is apparent from FIG. 6A, the spines 26 extend radially almost to the inner wall of the pressure vessel 1, and create a substantially circular envelope other than beneath the base plate 14. Each spine is provided with a plurality of pulleys 27 which support a cable 27A which surrounds all of the spines and is retained at either end adjacent to the base plate 14 by spring loaded support 28. The pulleys 27 could instead be replaced by round bars.

Figure 6B:
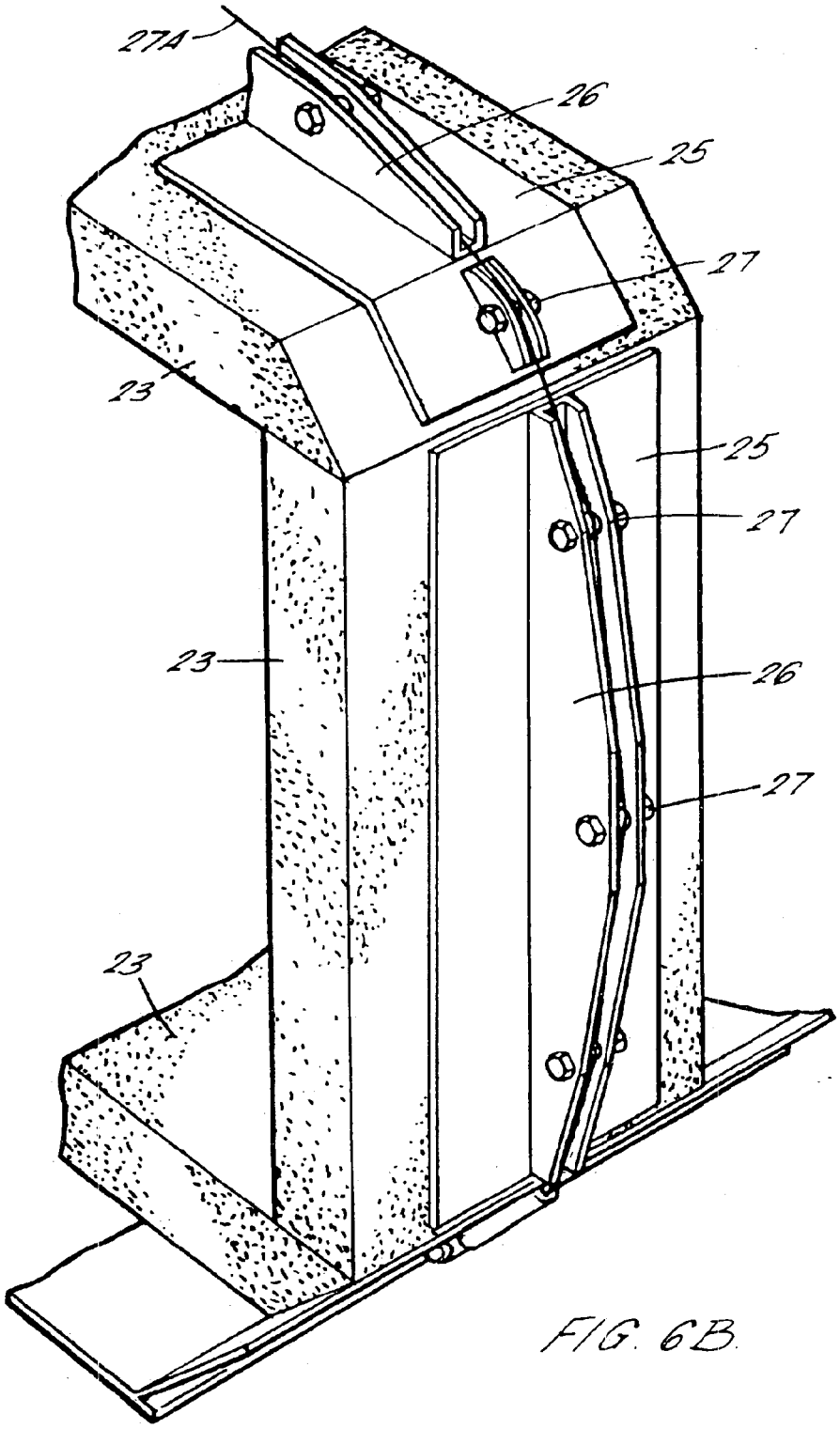
FIG. 6B is a perspective view showing a portion of the duct, insulation and base as shown in FIG. 6A.
Figure 6C:
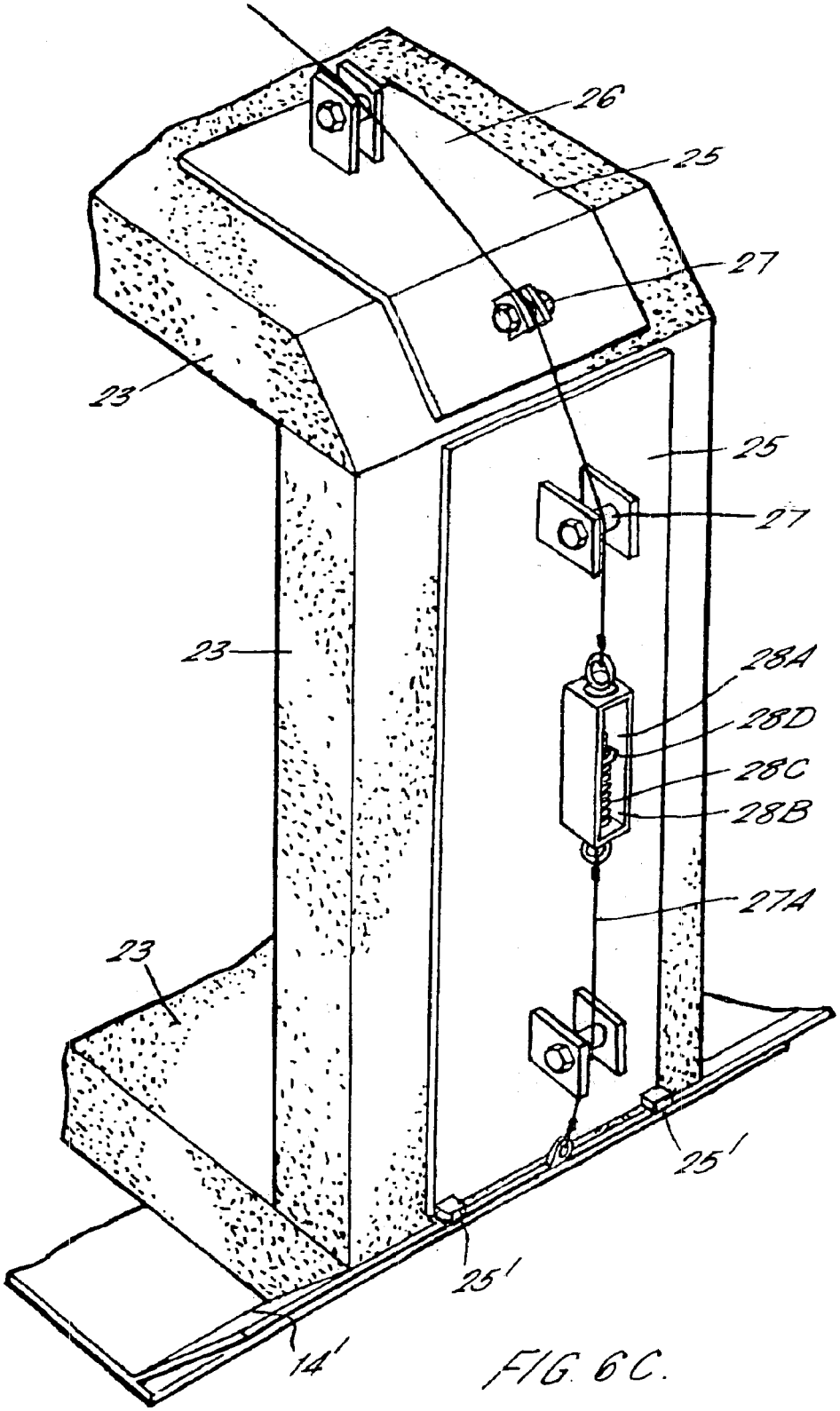
FIG. 6C is a view similar to FIG. 6B showing an alternative support for the cable.

An alternative duct support is shown in FIG. 6C. This is generally the same as the support of FIG. 6B and the same reference numerals are used to denote the same components. In this arrangement, the spines 26 are replaced by a pair of upstands 26A which perform the same function. The spring loaded support 28A is now provided midway along the side of the plate 25. The support 28A comprises a housing 28B containing a spring 28C and a limiter 28D to limit the travel of the spring to prevent it from being damaged. When the limited 28D reaches the end of its travel any further thermal expansion is accommodated by expansion of the cable 27A and loading of the duct wall.

A number of plates 25 are provided along the length of the duct 9. Each plate 25 may be provided with up to four cables 27A connected in parallel with associated supports to provide a degree of redundancy in case one or more of the cables should fail.

The arrangements of FIGS. 6B and 6C ensures that when the heat exchanger is in operation and the duct 9 undergoes thermal expansion, the springs in the spring loaded supports 28 expand, and the cable and spines 26 or upstands 26A apply a force across the whole width of the face of each block of insulation 23 thereby firmly supporting the duct 9. The duct 9 rests on the lower insulation block 23 and is free to move with respect to this block upon thermal expansion. When the heat exchanger is taken out of use and cooled down, the springs pull on the cable as the duct contracts, thereby ensuring that the insulation remains firmly supporting the duct.

What is claimed is:

1. A heat exchanger comprising a pressure vessel;

a first passage provided within a plurality of tubes for a first stream in one direction through the pressure vessel;

a second passage for a second stream in the opposite direction through the vessel, the second passage comprising a duct spaced from the pressure vessel and enclosing the tubes such that heat transfer occurs across the walls of the tubes;

means to generally equalise the pressure between the inside of the duct and the space between the duct and the pressure vessel;

thermal insulation between the duct and the inner surface of the pressure vessel; and a support to support the duct against expansion caused by the pressure inside the duct exceeding the pressure outside the duct;

wherein the insulation is held against the wall of the duct by the support.

2. A heat exchanger according to claim 1, wherein the means to equalise the pressure is one or more through holes in the wall of the duct.

3. A heat exchanger according to claim 2, wherein the or each through hole is provided at the cold end of the heat exchanger.

4. A heat exchanger according to claim 2 or claim 3, wherein a plurality of through holes are provided, the through holes all being situated generally in a single plane perpendicular to the direction of flow of the streams through the vessel.

5. A heat exchanger according to claim 1, wherein the support is provided by one or more cables which surround a substantial portion of the duct.

6. A heat exchanger according to claim 5, wherein the or each cable is spring loaded so as to allow the duct to expand and force the insulation outwardly, and to push the insulation back against the walls of the duct upon thermal contraction of the duct.

7. A heat exchanger according to claim 5 or claim 6, wherein the or each cable is supported on a spine or series of upstands projecting outwardly from a plate which extends across the outer face of the insulation.

8. A heat exchanger according to claim 1, wherein the duct rests on a base and is fixed to the base only at the hot end of the heat exchanger to allow for thermal expansion.

9. A heat exchanger according to claim 1, wherein the tubes are prestressed in their cold condition.

10. A heat exchanger according to claim 9, wherein the tubes are prestessed in their cold condition and tensioned by the rods which pass through the wall of the pressure vessel.

11. A heat exchanger according to claim 1, wherein the duct and/or the tubes are made of a number of different parts each of a different material connected in series.

12. A heat exchanger according to claim 1, wherein a plurality of passages are provided to convey the heated fluid from the tubes and out of the pressure vessel.

13. A heat exchanger according to claim 1, wherein a header assembly comprising a number of headers is provided within at least one end of the heat exchanger connected to the tubes and is configured such that each complete tube can pass by or through the header assembly.

14. A heat exchanger according to claim 1, further comprising one or more tube supports spaced from the sides of the duct and extending along the duct in the direction in which the streams pass through the pressure vessel.

15. A heat exchanger according to claim 14, wherein the or each tube support is provided by two or more duct sections each extending in parallel in the direction in which the streams pass through the pressure vessel.

16. A heat exchanger according to claim 1, wherein each tube is tortuous.

17. A heat exchanger according to claim 16, wherein each tube is sinuously wound.

18. A heat exchanger according to claim 16 or claim 17, wherein each tube is wound in a single plane to produce a flat structure.

19. A heat exchanger according to claim 18, wherein a series of fins or turbulence enhancers are provided to enhance the heat exchange across the walls of the tubes.

20. A heat exchanger according to claim 17 and claim 19, wherein the tube has straight sections separated by bends and the fins extend longitudinally along the straight sections of the tube.

21. A heat exchanger according to claim 1, wherein the tubes rest on ledges fixed to the walls of the duct such that the tubes are free to slide on the ledges.

* * * * *